US008979668B2

(12) United States Patent
Nakamura

(10) Patent No.: US 8,979,668 B2
(45) Date of Patent: Mar. 17, 2015

(54) PUTTER-TYPE GOLF CLUB HEAD AND PUTTER-TYPE GOLF CLUB

(75) Inventor: Takashi Nakamura, Kobe (JP)

(73) Assignee: SRI Sports Limited, Kobe (JP)

( * ) Notice: Subject to any disclaimer, the term of this patent is extended or adjusted under 35 U.S.C. 154(b) by 508 days.

(21) Appl. No.: 13/286,456

(22) Filed: Nov. 1, 2011

(65) Prior Publication Data

US 2012/0108357 A1 May 3, 2012

(30) Foreign Application Priority Data

Nov. 2, 2010 (JP) ..... 2010-246674

(51) Int. Cl.
*A63B 53/04* (2006.01)
*A63B 59/00* (2006.01)

(52) U.S. Cl.
CPC ..... *A63B 53/0487* (2013.01); *A63B 59/0092* (2013.01); *A63B 2053/0429* (2013.01); *A63B 2209/00* (2013.01)
USPC ..... 473/329; 473/340; 473/342

(58) Field of Classification Search
USPC ..... 473/324–350
See application file for complete search history.

(56) References Cited

U.S. PATENT DOCUMENTS 4,681,322 A * 7/1987 Straza et al. ..... 473/329
4,801,146 A * 1/1989 Honma ..... 473/342
5,083,778 A * 1/1992 Douglass ..... 473/329
5,299,807 A * 4/1994 Hutin ..... 473/329
5,467,983 A * 11/1995 Chen ..... 473/342
5,482,282 A * 1/1996 Willis ..... 473/342
5,485,997 A 1/1996 Schmidt et al.
5,586,947 A * 12/1996 Hutin ..... 473/324
5,605,511 A * 2/1997 Schmidt et al. ..... 473/324
5,766,093 A * 6/1998 Rohrer ..... 473/329
5,766,094 A * 6/1998 Mahaffey et al. ..... 473/342
5,827,131 A * 10/1998 Mahaffey et al. ..... 473/342
5,921,871 A * 7/1999 Fisher ..... 473/329
6,001,030 A * 12/1999 Delaney ..... 473/329
6,074,309 A * 6/2000 Mahaffey ..... 473/342
6,083,117 A * 7/2000 Hsu ..... 473/332
6,227,986 B1 * 5/2001 Fisher ..... 473/342
6,302,807 B1 * 10/2001 Rohrer ..... 473/329
6,425,831 B1 * 7/2002 Heene et al. ..... 473/332
6,431,997 B1 * 8/2002 Rohrer ..... 473/324
6,699,140 B1 * 3/2004 Sun ..... 473/252
6,875,124 B2 * 4/2005 Gilbert et al. ..... 473/290
7,413,517 B2 * 8/2008 Butler et al. ..... 473/288

(Continued)

FOREIGN PATENT DOCUMENTS

GB 2451317 A * 1/2009 ..... A63B 53/04
JP 01131682 A * 5/1989 ..... A63B 53/04

(Continued)

*Primary Examiner* — Alvin Hunter
(74) *Attorney, Agent, or Firm* — Birch, Stewart, Kolasch & Birch, LLP

(57) ABSTRACT

The present invention relates to a putter-type golf club head with a face on a front side to hit a golf ball comprising a head main portion provided with a concave portion on a side of the face, and a face insert made of elastic material attached to the concave portion of the head main portion, the face insert having a three-layer structure comprising of a first layer disposed at the front, a third layer disposed at the rear, and a second layer disposed between the first layer and the third layer, each of the first layer, the second layer, and the third layer having a hardness of h1, h2, and h3 and a rebound resilience of r1, r2, and r3, and the first layer, the second layer, and the third layer satisfying the following relations:

$h2<h1<=h3$, $r1>r2$, and $r1>r3$.

10 Claims, 6 Drawing Sheets

(56) References Cited

U.S. PATENT DOCUMENTS

| | | | | | |
|---|---|---|---|---|---|
| 8,092,318 | B2 * | 1/2012 | Oldknow et al. | ..... | 473/329 |
| 8,409,032 | B2 * | 4/2013 | Myrhum et al. | ..... | 473/342 |

FOREIGN PATENT DOCUMENTS

| | | | | | | |
|---|---|---|---|---|---|---|
| JP | 03007178 | A | * | 1/1991 | ..... | A63B 53/04 |
| JP | 06142239 | A | * | 5/1994 | ..... | A63B 53/04 |
| JP | 10000251 | A | * | 1/1998 | ..... | A63B 53/04 |
| JP | 11244431 | A | * | 9/1999 | ..... | A63B 53/04 |
| JP | 2001170231 | A | * | 6/2001 | ..... | A63B 53/04 |
| JP | 2004-236985 | A | | 8/2004 | | |
| JP | 2004236985 | A | * | 8/2004 | ..... | A63B 53/04 |
| JP | 2012010767 | A | * | 1/2012 | | |
| JP | 2012095859 | A | * | 5/2012 | | |
| JP | 2013009735 | A | * | 1/2013 | | |

* cited by examiner

X−X Section

Y−Y Section

PUTTER-TYPE GOLF CLUB HEAD AND PUTTER-TYPE GOLF CLUB

BACKGROUND OF THE INVENTION

1. Technical Field

The present invention relates to a putter-type golf club head and a putter-type golf club capable of enhancing an impact feeling while keeping a rolling distance and direction high level.

2. Related Art

In recent years, a putter-type golf club head including a head main portion made of metal, and a face insert made of elastic material and arranged in a concave portion of the head main portion has been known. With such a putter-type golf club, soft impact feeling can be obtained.

Japanese Patent Application Publication No. H08-196668 proposes use of an elastomer as an elastic material for a face insert in order to make impact feeling of a putter softer. However, if a soft face insert is used, there is a fear that a launch direction of a golf ball may deviate in a subtle way (degradation of directionality) or undesirable, unnecessary spin may be generated.

In order to solve the defects described above, Japanese Patent Application Publication No. 2004-236985 proposes a face insert having a two-layer structure in which a relatively hard elastic material is used on a front side. However, with such a putter-type golf club head, soft impact feeling cannot be obtained.

SUMMARY OF THE INVENTION

The present invention has been made in light of the actual circumstances described above, and an object of the present invention is to provide a putter-type golf club head and a putter-type golf club capable of obtaining good, soft impact feeling while keeping a rolling distance and directionality of a golf ball at a high level, by making a face insert a three-layer structure, and providing a relationship of hardness and a rebound resilience of each layer.

According to the present invention, a putter-type golf club head having a face on a front side to hit a golf ball comprises a head main portion provided with a concave portion on a side of the face, and a face insert made of elastic material attached to the concave portion of the head main portion, the face insert having a three-layer structure comprising of a first layer disposed at the front, a third layer disposed at the rear, and a second layer disposed between the first layer and the third layer, each of the first layer, the second layer, and the third layer having a hardness of h1, h2, and h3 and a rebound resilience of r1, r2, and r3, and the first layer, the second layer, and the third layer satisfying the following relations:

$$h2<h1<=h3,$$

$$r1>r2,$$

and $$r1>r3.$$

DETAILED DESCRIPTION OF THE PREFERRED EMBODIMENT

An embodiment of the present invention will be described hereinafter on the basis of the drawings.

Figure 1:
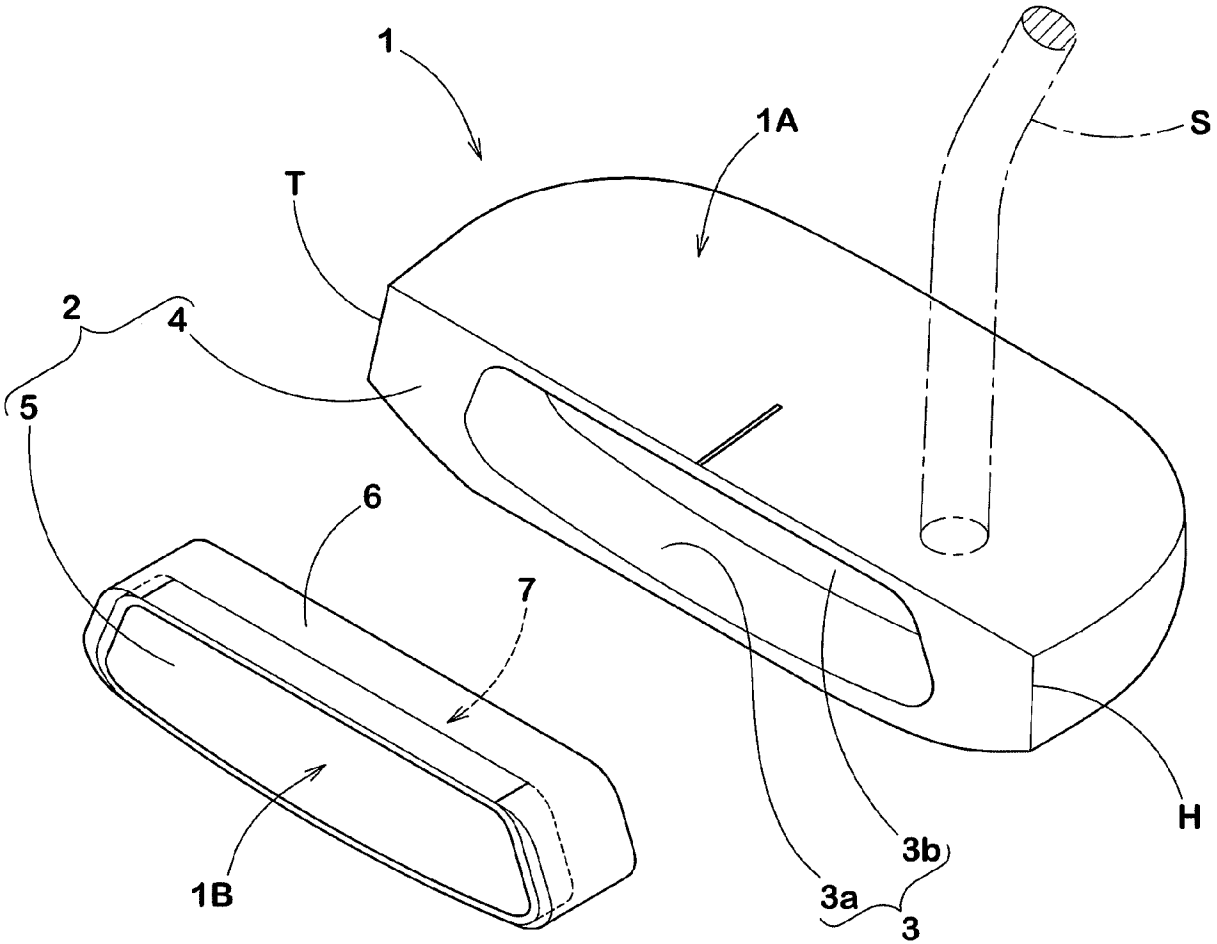
FIG. 1 is an exploded perspective view of a putter-type golf club head of this embodiment.

As shown in FIG. 1, a putter-type golf club head (hereinafter simply referred to as a "putter head") 1 of the embodiment has a face 2 to hit a golf ball on a front side.

The face 2 is a plain surface, and configured to have an almost horizontally long, rectangular shape which is long in toe T and heel H direction (horizontal direction). In addition, the face 2 is inclined with a small loft angle from 1 to 3 degrees, for example.

The putter head 1 includes a head main portion 1A provided with a concave portion 3 on a side of the face 2 (front side), and a face insert 1B made of elastic material attached to the concave portion 3 of the head main portion 1A.

The head main portion 1A is preferably made of metallic materials such as an aluminum alloy, stainless, titanium, or soft iron, and is formed of an almost block shape which extends backwardly from an upper edge, a lower edge, a toe side edge, and a heel side edge of the face 2. The head main portion 1A is manufactured by various methods such as casting, forging or cut-out. In addition, for example, a lower end of a club shaft S is firmly fixed to a top surface of the head main portion 1A.

The concave portion 3 is formed across main parts of the face 2 in a toe-heel direction and an up-down direction, and has an annular inner circumferential surface 3*a* which delimits a contour of the concave portion 3 and a bottom surface 3*b* which closes the inner circumferential surface 3*a* on the head interior side. Such a concave portion 3 forms a bottomed space which sags from the face 2. Although the concave portion 3 of the embodiment is formed like a rectangular shape which is horizontally long in the toe-heel direction almost following a contour of the face 2, it should not be limited to such an aspect. In addition, an annually continuing front surface marginal part 4 is formed on a front surface of the head main portion 1A and around the concave portion 3.

The face insert 1B is formed like a block having a front surface 5 exposed to and disposed on the side of the face 2, a back surface 7 which is a face opposite thereto, and an outer circumferential surface 6 which continues and annually extends between the front surface 5 and the back surface 7. The face insert 1B has the back surface 7 face the bottom surface 3*b* of the concave portion 3 and the outer circumferential surface 6 face the inner circumferential surface 3 of the concave portion 3, and is disposed in a close relation in a preferred embodiment. Then, by attaching the face insert 1B to the concave portion 3 of the head main portion 1A, the front surface 5 of the face insert 1B and the front surface marginal part 4 of the head main portion 1A form a substantially single plain surface, thereby forming the face 2. In addition, the face insert 1B is firmly fixed to the concave portion 3 of the head main portion 1A by means of a double-sided tape or an adhesive and the like.

Figure 2:
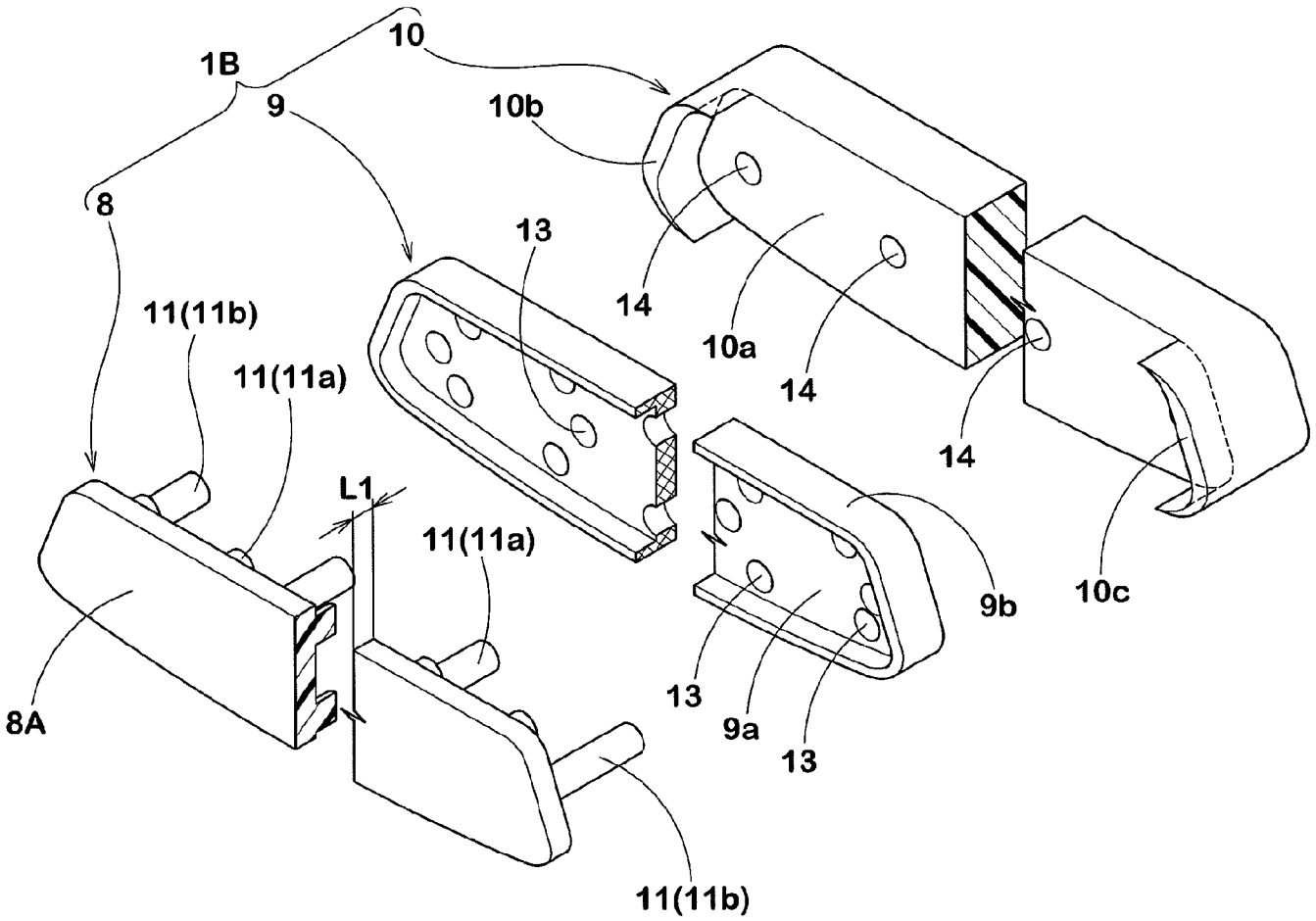
FIG. 2 is an exploded perspective view of a face insert thereof.

As shown in FIG. 2 in an exploded manner, the face insert 1B has a three-layer structure including a first layer 8 disposed at the front, a third layer 10 disposed at the rear, and a second layer 9 disposed between the first layer 8 and the third layer 10. Then, the present invention is characterized in that when the first layer 8, the second layer 9, and the third layer 10 have hardness of h1, h2, and h3, and a rebound resilience of r1, r2, and r3, respectively, they satisfy the following relations:

$$h2<h1<=h3$$

$$r1>r2$$

$$r1>r3.$$

More specifically, as a result of various experiments, the inventor et. al found that it is possible to strike a balance of obtaining soft impact feeling and keeping a rolling distance and direction of a golf ball at a high level, by satisfying a relationship of the following three conditions:

(a) Make the hardness of the second layer 9 the smallest.

(b) Make the hardness of the third layer 10 greater than the hardness of the first layer 8.

(c) Make the rebound resilience of the first layer 8 greater than the rebound resilience of the second layer 9 and the third layer 10.

More specifically, the present invention can achieve soft impact feeling as well, while keeping a rolling distance and direction of a golf ball at a high level, by simultaneously satisfying the three conditions of (a) to (c) above. In addition, measurements are made with each hardness h1, h2, and h3 as shore D hardness.

Above all, satisfying the conditions (a) and (b), i.e., by making the second layer 9, which is positioned at the center, the softest, and by making the first layer 8 and the third layer 10, which are positioned before and after it, relatively harder, deflection of the face insert when a golf ball is hit is moderately controlled, while good impact feeling is still maintained. In addition, by making the rebound resilience of the first layer 8, which comes into direct contact with a golf ball, the greatest by the condition (c), not only directional stability of a golf ball can be improved but also rolling of a golf ball is improved, while preventing generation of unnecessary spin by accelerating so-called letting go of a ball when the ball is hit. On the other hand, as the second layer and the third layer which have small rebound resilience have great vibrational absorption effect, they are useful in absorbing uncomfortable vibration and maintaining good impact feeling. These actions will be revealed in embodiments to be described below.

As elastic material to be used in respective layers 8 to 10 of the face insert 1B, an ionomer resin, a urethane resin, a synthetic resin of a urethane elastomer, a polyester elastomer, or a polyamide elastomer and the like, or a rubber elastic body such as a styrene-butadiene rubber or a butadiene rubber is preferred.

It is desirable that the Sore D hardness h1 of the first layer 8 is 40° to 70°. More specifically, if the hardness h1 is less than 40°, deflection of the face insert 1B when a golf ball is hit increases, and directionality of the golf ball tends to degrade. In contrast, when the hardness h1 exceeds 70°, it may not be possible to achieve soft impact feeling. Above all, it is desirable that the hardness h1 of the first layer 8 is more preferably 45° or more and even more preferably 50° or more, or more preferably 65° or less and even more preferably 60° or less.

Now, the shore D hardness of the elastic material conforms to the provision in "ASTM-D 2240-68", and is measured by an automatic rubber hardness tester (Product name "P1" of Kobunshi Keiki Co., Ltd.) provided with a shore D type hardness tester. In measurements, 2-mm thick sheets fabricated of the same material as the layers of the face insert are used. Prior to a measurement, the sheets are stored in the temperature of 23° C. for two weeks, and three sheets are superposed when a measurement is performed.

It is desirable that the rebound resilience r1 of the first layer 8 is 50% to 80%. When the rebound resilience r1 is less than 50%, rolling of a golf ball may degrade. In contrast, when the rebound resilience r1 exceeds 80%, not only the rolling of a golf ball excessively improves, but also uncomfortable vibration tends to be transmitted to hands of a golf player. Above all, it is desirable that the rebound resilience r1 is more preferably 55% or more and even more preferably 60% or more, or more preferably 75% or less and even more preferably 70% or less.

The rebound resilience conforms to the provision in "JIS K 6255", and is obtained by a Lupke rebound resilience test (test temperature and humidity of 23° C., 50 RH %). A disk shaped slab which is molded by a hot press and has a thickness of 2 mm and a diameter of 28 mm is used in measurements. In a measurement, six slabs are superposed. Slabs comprising the same composition as elastic material of each layer of the face insert is used in measurements. In addition, slabs are stored in advance in the temperature of 23° C. for two weeks.

Figure 3:
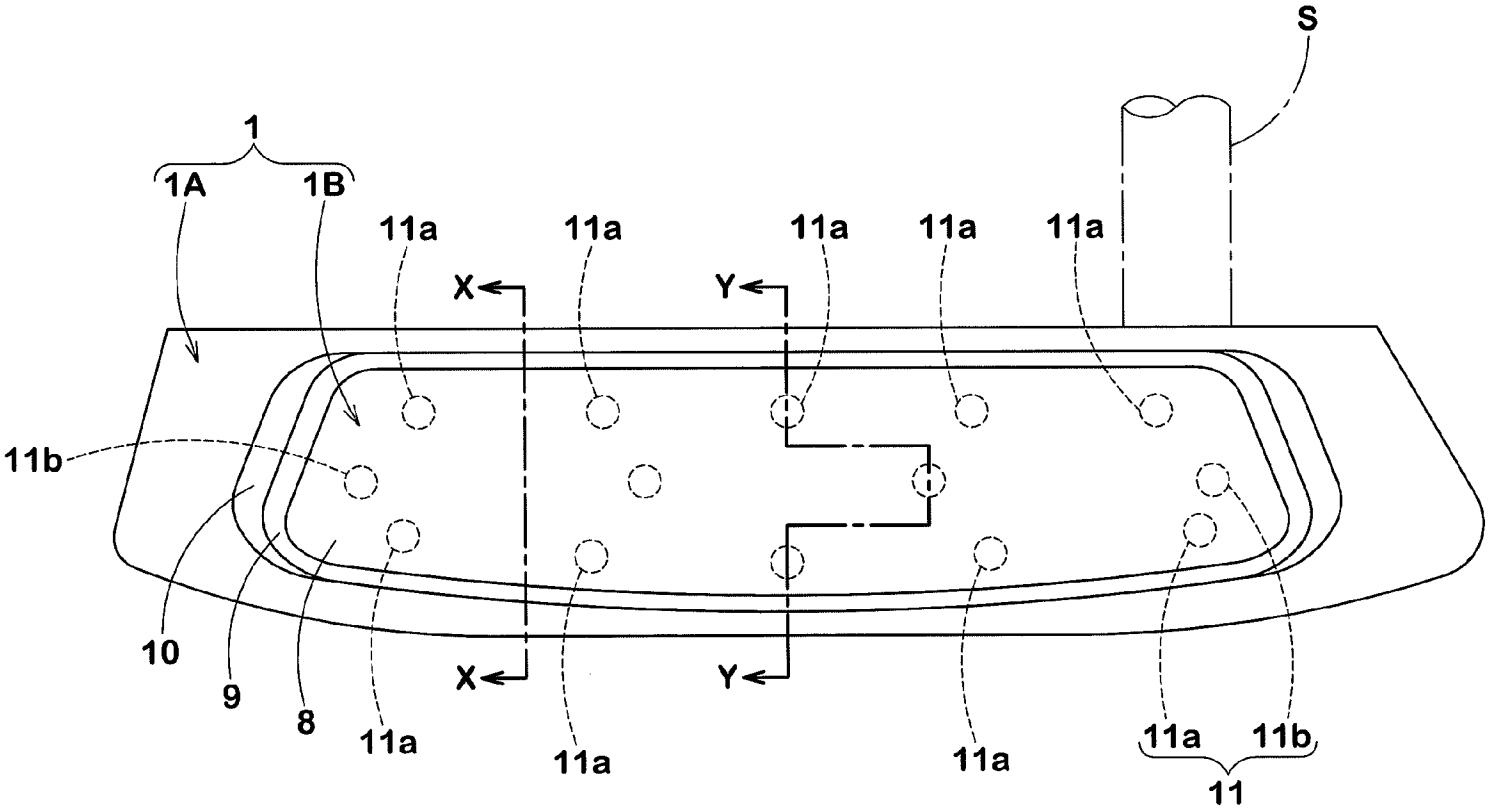
FIG. 3 is a front view of a putter-type golf club head.
Figure 4:
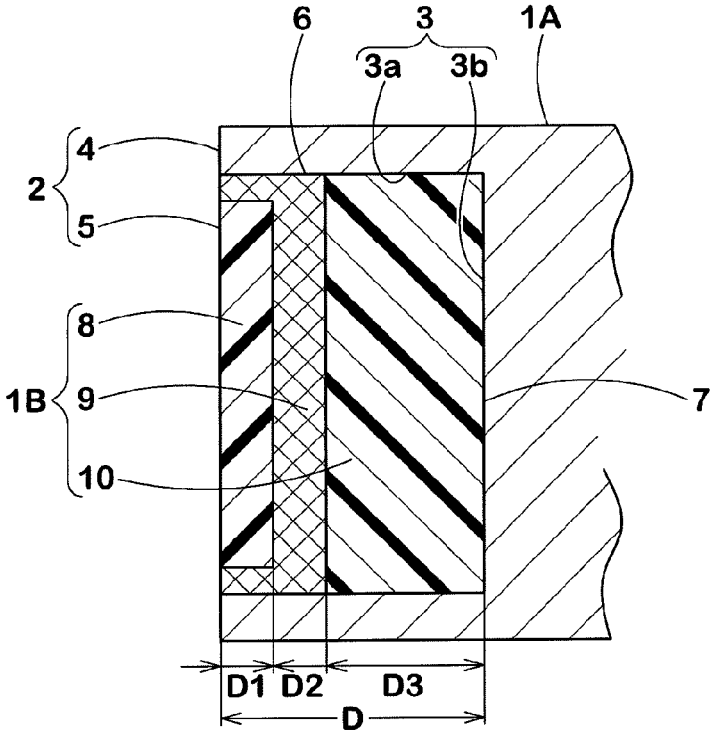
FIG. 4 is a cross sectional view taken along X-X of FIG. 3.

As shown in FIG. 4 which is a cross sectional view taken along x-x in FIG. 3, it is desirable that a thickness D1 of the first layer 8 is preferably set from 0.3 to 3.0 mm. When the thickness D1 is small, it may not be possible to obtain sufficiently soft impact feeling. In contrast, when the thickness D1 is great, a deflecting part increases, and thus directionality of a golf ball may degrade. Above all, it is desirable that the thickness D1 is more preferably 0.5 mm or more and even more preferably 0.8 mm or more, or more preferably 2.8 mm or less and even more preferably 2.5 mm or less.

In addition, if thickness of each layer of the face insert 1B is not constant, thickness of a central area in a toe-heel direction, which is in direct or indirect contact with a golf ball most frequently, is made smallest.

As described above, although the Shore D hardness h2 of the second layer 9 is preferably set smaller than the hardness h1 of the first layer 8 and the hardness h3 of the third layer 10, it is desirable that the hardness h2 is preferably in a range of from 30 to 60°. When the hardness h2 is less than 30°, deflection of the first layer 8 when a golf ball is hit cannot be controlled, and thus directionality of the golf ball may degrade. In contrast, when the hardness h2 exceeds 60°, it may not be possible to obtain soft impact feeling. Above all, it is desirable that the shore D hardness h2 of the second layer 9 is more preferably 35° or more and even more preferably 40° or more, or more preferably 55° or less and even more preferably 50° or less.

It is desirable that the rebound resilience r2 of the second layer 9 is preferably set in a range of from 20 to 50%. When the rebound resilience r2 is less than 20%, deflection of the face insert when a golf ball is hit becomes too great, which makes it difficult to transmit impact feeling to hands of a golf player, who thus finds it difficult to gain a sense of distance. In contrast, when the rebound resilience r2 is more than 50%, uncomfortable vibration when a golf ball is hit may be transmitted to hands of a golf player. Above all, it is desirable that the rebound resilience r2 of the second layer 9 is more preferably 25% or more and even more preferably 30% or more, or more preferably 45% or less and even more preferably 40% or less.

It is good if a thickness D2 of the second layer 9 is 0.6 to 5.0 mm. When the thickness D2 falls below 0.6 mm, it may not be possible to obtain soft impact feeling. In contrast, when the thickness D2 exceeds 5.0 mm, deflection of the first layer 8 cannot be controlled, and directionality of a golf ball may degrade. Above all, it is desirable that the thickness D2 of the second layer 9 is more preferably 0.8 mm or more and even more preferably 1.0 mm or more, or more preferably 4.8 mm or less and even more preferably 4.6 mm or less. Then, in particular, it is desirable that the thickness D2 is 20 to 35% of the entire thickness D of the face insert 1B.

It is desirable that the shore D hardness h3 of the third layer 10 is preferably set in a range of from 40 to 70°. When the hardness h3 is less than 40°, deflection of the face insert 1B when a golf ball is hit increases, and thus directionality of a golf ball may degrade. In contrast, when the hardness h3 exceeds 70°, it may not be possible to obtain soft impact feeling. Above all, it is desirable that the shore D hardness h3 of the third layer 10 is more preferably 45° or more and even more preferably 50° or more, or more preferably 65° or less and even more preferably 60° or less.

It is desirable that the rebound resilience r3 of the third layer 10 is set in a range of from 20 to 50%. When the rebound resilience r3 is less than 20%, deflection of the face insert 1B increases, which makes it difficult to transmit impact feeling to hands of a golf player, who thus finds it difficult to gain a sense of distance. In contrast, if the rebound resilience exceeds 50%, vibration when a golf ball is hit may not be absorbed sufficiently. Above all, it is desirable that the rebound resilience r3 is more preferably 25% or more and even more preferably 30% or more, or more preferably 45% or less and even more preferably 40% or less.

It is desirable that a thickness D3 of the third layer 10 is set in a range of from 0.5 to 8.0 mm. When the thickness D3 is less than 0.5 mm, it may not be possible to obtain soft impact feeling. In contrast, when the thickness D3 exceeds 8.0 mm, a deflecting part when a golf ball is hit increases, and impact feeling may become significantly softer. Above all, it is desirable that the thickness D3 of the third layer 10 is more preferably 0.7 mm or more and even more preferably 1.0 mm or more, or more preferably 7.5 mm or less and even more preferably 7.0 mm or less.

In addition, as is obvious from FIG. 2 and FIG. 3, the first layer 8 of the face insert 1B of the embodiment includes a plate portion 8A extending from a toe side to a heel side of the face and a plurality of projections 11 extending backwardly from the rear of the plate portion 8A. In addition, the thickness D1 is a thickness at a position where the projections 11 are removed.

In the embodiment, the projections 11 include short projections 11*a* and long projections 11*b* which are longer than the short projections 11*a*.

Figure 5:
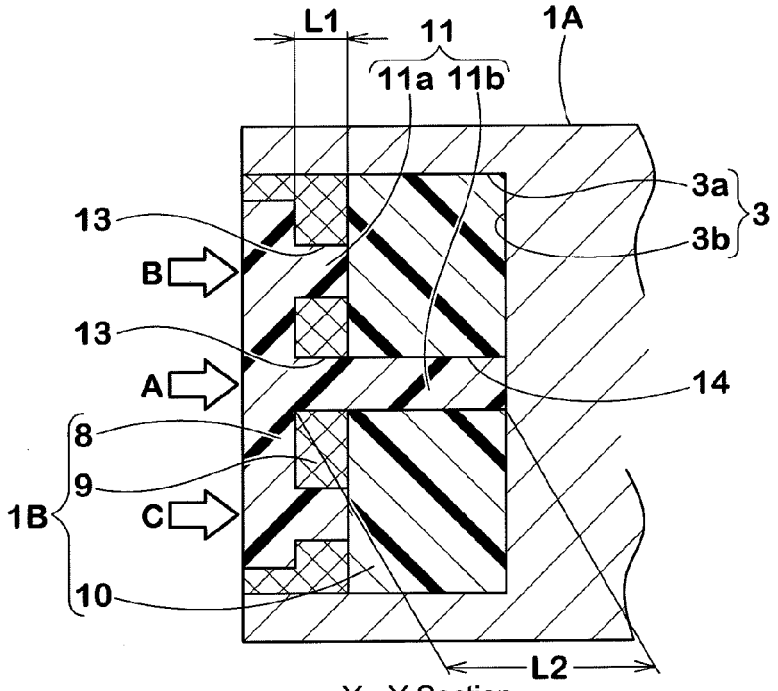
FIG. 5 is a cross sectional view taken along Y-Y of FIG. 3.

As is obvious from FIG. 3 and FIG. 5, the short projections 11*a* of the embodiment include a plurality of projections (5 projections each in this example) which are each intermittently arranged in the toe-heel direction on the side of the upper edge and the lower edge of the rear of the first layer 8. A length L1 of the short projections 11*a* is formed to be substantially equal to the thickness D2 of the second layer 9.

In addition, as is obvious from FIG. 3, the long projections 11*b* in the embodiment include a plurality of projections (4 projections each in this example) which are intermittently arranged in the toe-heel direction in the almost central area of the up-down direction of the rear of the first layer 8. A length L2 of the long projections 11*b* is formed to be substantially equal to a sum (D2+D3) of the thickness D2 of the second layer 9 and the thickness D3 of the third layer 10.

As shown in FIG. 2, the second layer 9 of the embodiment includes a plate portion 9*a*, and a flange 9*b* which protrudes forward from a front surface of the plate portion 9*a* and continuously covers an outer circumferential surface of the plate portion 8A of the first layer 8. Such a second layer 9 is preferable in that it absorbs and damps vibration components in many directions, including vibration in the up-down and toe-heel directions as well as vibration in a front-back direction of the first layer 8.

In addition, on the plate portion 9*a* of the second layer 9 are formed a plurality of holes 13 including through holes in which projections 11 (the short projections 11*a* and the long projections 11*b*) are inserted. Then, through insertion of respective projections 11*a*, 11*b* into the holes 13, the first layer 8 and the second layer 9 are strongly and integrally joined.

The third layer 10 of the embodiment includes a plate portion 10*a*, a toe-side flange 10*b* which protrudes forward from the front surface of the plate portion 10*a* and from the toe T side and covers an outer circumferential surface of the second layer 9, and a heel-side flange 10*c* which protrudes forward from the front surface of the plate portion 10*a* and from the heel H side and covers the outer circumferential surface of the second layer 9. Such a third layer 10 is also preferable in that it absorbs and damps vibration components in many directions, including vibration in the toe-heel direction of the first layer 8 and the second layer 9.

In addition, on the plate portion 10*a* of the third layer 10 are formed a plurality of holes 14 into which only the long projections 11*b* are inserted. Then, through insertion of the long protrusions 11 of the firs layer 8 into the holes 14, the first layer 8, the second layer 9, and the third layer 10 are strongly and integrally joined.

As shown in FIG. 5, while the long protrusions 11*b* arranged in the central part of the face insert 1B in the up-down direction abut against the bottom surface 3*b* of the head main portion 3 made of metallic materials, the short protrusions 11*a* are in contact with the front surface of the third layer 10. Such a face insert 1B can make an entire apparent rebound resilience when a ball is hit with the upper edge side B or the lower edge side c smaller than when a ball is hit with the central area A, which is a preferred hit position, in the up-down direction. Thus, impact absorption performance can be improved by reserving great deflection when a ball is hit with the upper edge side B or the lower edge side C, which are clearly hit positions of mishits.

FIG. 6 shows one embodiment of a method for manufacturing a face insert.

Figure 6A:
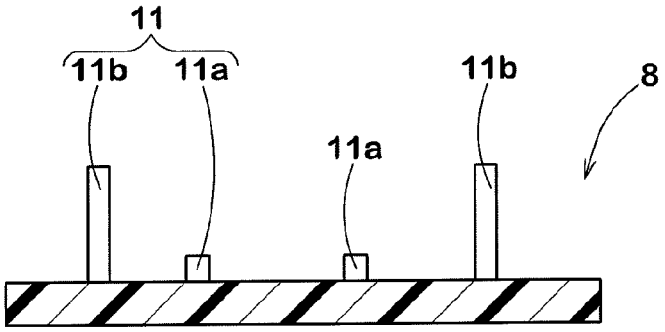
FIG. 6A to FIG. 6*c* are cross sectional views illustrating a method for manufacturing a face insert.

In the embodiment, as shown in FIG. 6A, first of all, the first layer 8 having the projections 11 are fabricated by, for example, injection molding and the like.

Figure 6B:
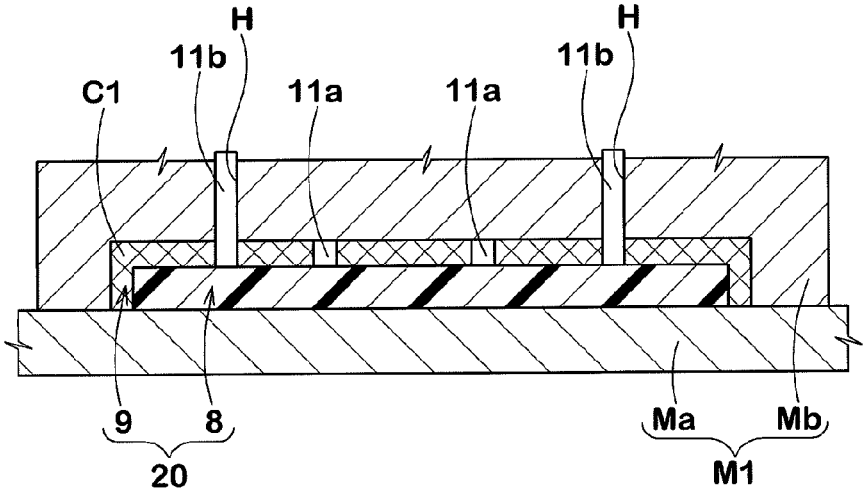

Then, as shown in FIG. 6B, the first layer 8 is set in a first mold M1. The first mold M1 includes a lower mold Ma on which the first layer 8 is placed and an upper mold Mb which covers the lower mold Ma, and on the upper mold Mb are provided holes H into which the long projections 11 can be inserted. Then, a cavity c1 for forming the second layer 9 around the first layer 8 is formed, by aligning the holes H with the long projections 11*b* of the first layer 8 placed on the lower mold Ma and then closing the upper mold Mb. Then, composition forming the second layer 9 is injected into the cavity C1. This enables an integral mold 20 of the first layer 8 and the second layer 9 to be obtained in the first mold M1.

Figure 6C:
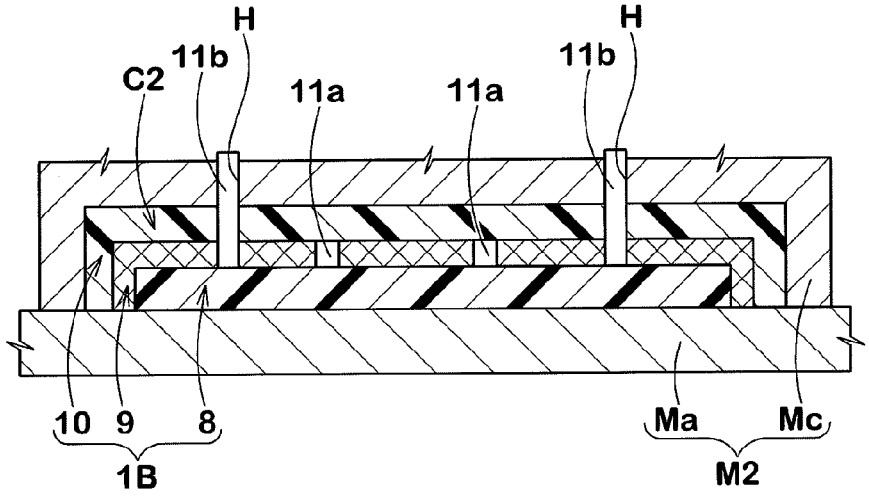

Next, as shown in FIG. 6C, the integral mold 20 of the first layer 8 and the second layer 9 is set in a second mold M2. The second mold M2 includes, for example, the lower mold Ma on which the integral mold 20 is placed and an upper mold Mc which covers the lower mold Ma, and on the upper mold Mc are also provided holes H into which the long projections 11 can be inserted. Then, a cavity c2 for forming the third layer 10 around the integral mold 20 is formed by aligning the holes H with the long projections 11*b* of the integral mold 20 placed on the lower mold ma and closing the upper mold Mc. Then, composition forming the third layer 10 is injected into the cavity c2. This enables the face insert 1B, which is an integral mold of the first layer 8, the second layer 9, and the third layer 10, to be obtained in the second mold M2.

Since with the manufacturing method described above, positioning of a mold (the upper molds Mb and Mc) can be easily done relative to the projections 11 of the first layer 8, the face insert 1B can be molded precisely.

[Comparison Test]

To check the effect of the present invention, a putter-type golf club whose total length was 34 inches was manufactured experimentally by attaching a shaft to a putter-type golf club head having the basic configuration as shown in FIG. 1, and an actual hit test thereof was performed. A head main portion was a casting of SUS630. A face insert had a basic configuration shown in FIG. 2, a thickness of a flange unit of a second layer was 1 mm, and a thickness of a maximum part of a flange unit of a third layer was 2 mm.

Actual tests were performed by 10 golfers repeating putting of 6 m five times, using commercially available 3 piece golf balls (Z-UR) made by SRI Sports Limited. Then, for impact feeling, degree of hardness when each golfer putts and vibration transmitted to hands were evaluated based on feeling and with the following criteria, and all averages were considered results. They show that the greater a numeric value is, the better impact feeling is.

<Impact Feeling (Hardness)>

5 points . . . very soft 4 points . . . Soft 3 points . . . common (on the basis of the comparative example 1)

2 points . . . Hard 1 point . . . very hard

<Impact Feeling (Vibration)>

5 points . . . vibration transmitted to hands is very small.

4 points . . . vibration transmitted to hands is small.

3 points . . . Common (on the basis of the Comparative example 1)

2 points . . . vibration transmitted to hands is large.

1 point . . . vibration transmitted to hands is very large.

Figure 7:
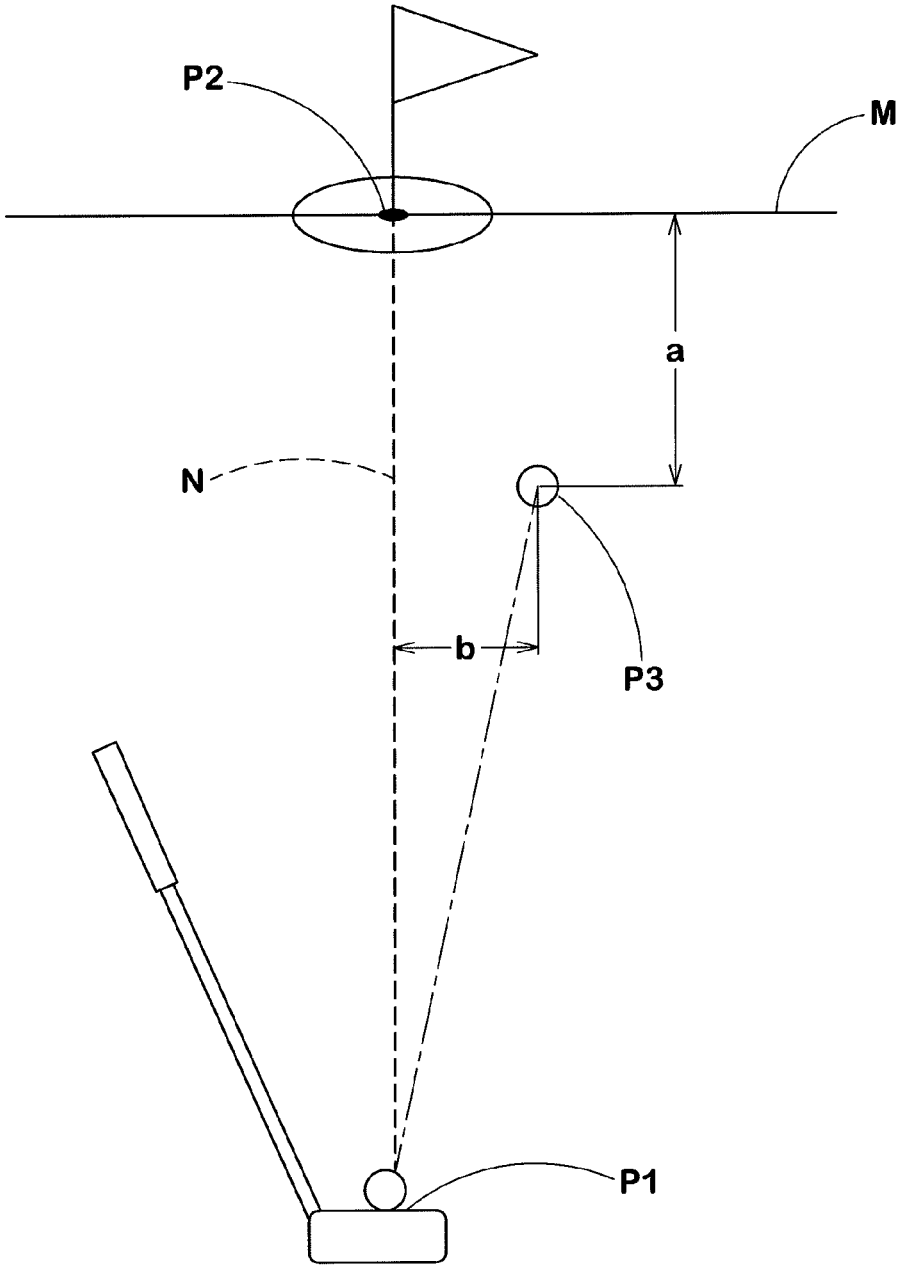
FIG. 7 is a diagrammatic view showing the way of an actual hitting test.

As shown in FIG. 7, horizontal deviation b from a vertical line N that connects a ball launch position P1 and a target position P2 to a ball stop position P3, and vertical deviation a from a horizontal line M that passes through the target position P2 and is orthogonal to the vertical line N to the ball stop position P3 were measured. Average horizontal deviation and average vertical deviation, which were averages of respective horizontal deviation b and vertical deviation a of the 10 golfers, were calculated, and evaluation was shown by indices with the Comparative example 1 as 1. This means that the greater a numeric value is, the greater deviation is and the worse the performance is. Test results and the like are shown in Table 1.

TABLE 1

| | | Comparative Example 1 | Comparative Example 2 | Comparative Example 3 | Comparative Example 4 | Comparative Example 5 | Example 1 | Example 2 | Comparative Example 6 | Example 3 | Comparative Example 7 | Comparative Example 8 | Example 4 | Comparative Example 9 | Comparative Example 10 |
|---|---|---|---|---|---|---|---|---|---|---|---|---|---|---|---|
| | Number of Layers of Face Insert | 1 | 2 | 2 | 2 | 2 | 3 | 3 | 3 | 3 | 3 | 3 | 3 | 3 | 3 |
| First layer | Material | PEBAX | PEBAX | PEBAX | TPU | PEBAX | PEBAX | PEBAX | PEBAX | PEBAX | PEBAX | PEBAX | PEBAX | PEBAX | PEBAX |
| | Hardness h1 (Shore D) | 55 | 55 | 40 | 55 | 55 | 55 | 63 | 35 | 55 | 55 | 55 | 55 | 55 | 55 |
| | Rebound Resilience r1 (%) | 59 | 59 | 63 | 35 | 59 | 59 | 56 | 70 | 59 | 59 | 59 | 59 | 59 | 59 |
| | Thickness D1 (mm) | 6 | 2 | 2 | 2 | 2 | 2 | 2 | 2 | 2 | 2 | 2 | 2 | 2 | 2 |
| Second layer | Material | — | PEBAX | PEBAX | PEBAX | TPU | TPU | TPU | TPU | TPU | PEBAX | TPU | TPU | TPU | TPU |
| | Hardness h2 (Shore D) | — | 63 | 63 | 63 | 45 | 45 | 45 | 45 | 40 | 40 | 65 | 45 | 45 | 45 |
| | Rebound Resilience r2 (%) | — | 56 | 56 | 56 | 30 | 30 | 30 | 30 | 40 | 63 | 40 | 30 | 30 | 30 |
| | Thickness D2 (mm) | — | 4 | 4 | 4 | 4 | 2 | 2 | 2 | 2 | 2 | 2 | 2 | 2 | 2 |
| Third layer | Material | — | — | — | — | — | TPU | TPU | TPU | TPU | TPU | TPU | TPU | PEBAX | TPU |
| | Hardness h3 (Shore D) | — | — | — | — | — | 55 | 55 | 55 | 55 | 55 | 55 | 65 | 55 | 40 |
| | Rebound Resilience r3 (%) | — | — | — | — | — | 35 | 35 | 35 | 35 | 35 | 35 | 40 | 59 | 40 |
| | Thickness D3 (mm) | — | — | — | — | — | 2 | 2 | 2 | 2 | 2 | 2 | 2 | 2 | 2 |
| Test result | Impact Feeling (Hardness) | 3.0 | 2.8 | 3.5 | 3.0 | 4.5 | 4.4 | 4.1 | 4.6 | 4.4 | 4.0 | 3.2 | 4.2 | 3.9 | 4.5 |
| | Impact Feeling (Vibration) | 3.0 | 3.0 | 2.2 | 3.5 | 4.2 | 4.1 | 4.1 | 3.7 | 4.0 | 2.8 | 3.6 | 4.1 | 2.9 | 4.1 |
| | Sum of Evaluation of Impact Feeling | 6.0 | 5.8 | 5.7 | 6.5 | 8.7 | 8.5 | 8.2 | 8.3 | 8.4 | 6.8 | 6.8 | 8.3 | 6.8 | 8.6 |
| | Vertical Deviation Index | 1.0 | 0.7 | 1.0 | 1.5 | 1.2 | 0.7 | 0.6 | 1.2 | 0.7 | 0.8 | 0.7 | 0.6 | 0.7 | 1.3 |
| | Horizontal Deviation Index | 1.0 | 0.5 | 1.1 | 1.1 | 1.6 | 0.6 | 0.5 | 1.1 | 0.8 | 0.7 | 0.7 | 0.6 | 0.7 | 1.7 |
| | Sum of Deviation Indices | 2.0 | 1.2 | 2.1 | 2.6 | 2.8 | 1.3 | 1.1 | 2.3 | 1.5 | 1.5 | 1.4 | 1.2 | 1.4 | 3.0 |
| | Remarks about Performance Evaluation | | If a hard second layer is included, directionality improves. However, impact feeling becomes harder. | If a first layer is made soft, impact feeling is improved. However, the improvement is not enough, and directionality also degrades. | When a rebound resilience of a first layer is low, rolling degrades, and a sense of vertical distance deteriorates. | If a second layer which is soft and has low rebound is included, impact feeling improves. However, if thickness is great, directionality degrades. | Thinning a second layer and adding a third layer improve directionality without obstructing impact feeling. | | If the first layer is too soft, horizontal deviation increases. | | If a second layer which is soft but has high rebound is included, adequate effect on impact feeling cannot be achieved. | When a second layer has low rebound but is hard, a golfer does not sense soft impact feeling. | | When a third layer has high rebound, vibration absorption is little and impact feeling is bad. | |

In addition, symbols of materials of the face insert in Table 1 are as follows:

PEBAX: Polyether block amide (manufacturer: Arkema Inc.)

TPU: Thermoplastic urethane resin (Product name: Elastollan 11TYPE, made by BASF Corporation)

As a result of testing, it was confirmed that the putter-type golf club of the embodiment had small deviation, and kept a rolling distance or direction of a golf ball at a high level. In addition, good result was also obtained for impact feeling.

The invention claimed is:

1. A putter-type golf club head having a face on a front side to hit a golf ball, the head comprising a head main portion provided with a concave portion on a side of the face, and a face insert attached to the concave portion of the head main portion, the face insert having a three-layer structure comprising a first layer disposed at the front, a third layer disposed at the rear, and a second layer disposed between the first layer and the third layer, wherein each of the first layer, the second layer, and the third layer is made of elastic material, each of the first layer, the second layer, and the third layer having a Shore D hardness of h1, h2, and h3, respectively, and a Lupke rebound resilience at a temperature of 23° C. and a humidity of 50 RH % of r1, r2, and r3, respectively, and the first layer, the second layer, and the third layer satisfying the following relations:

$$h2<h1<=h3,$$

$$r1>r2,$$

and $$r1>r3.$$

2. The putter-type golf club head according to claim 1, wherein a thickness of the second layer is in a range of from 20% to 35% of a whole thickness of the face insert.

3. The putter-type golf club head according to claim 1 or 2, wherein the first layer comprises a plate portion extending from a toe side to a heel side of the face and a plurality of projections extending backwardly from the plate portion, and the second layer has a plurality of holes in which the projections are inserted.

4. The putter-type golf club head according to claim 3, wherein the third layer has a plurality of holes in which the projections are inserted, and the projections include at least one long projection which penetrates the second layer and the third layer.

5. The putter-type golf club head according to claim 3, wherein the projections include at least one short projection which penetrates only the second layer and terminates at the front surface of the third layer.

6. A putter-type golf club comprising a putter-type golf club head defined by claim 1, and a club shaft attached to the golf club head.

7. The putter-type golf club head according to claim 1, wherein the Shore D hardness of the first layer is in a range of from 40 to 70 degrees.

8. The putter-type golf club head according to claim 1, wherein the Shore D hardness of the second layer is in a range of from 30 to 60 degrees.

9. The putter-type golf club head according to claim 1, wherein the Shore D hardness of the third layer is in a range of from 40 to 70 degrees.

10. The putter-type golf club head according to claim 1, wherein the Shore D hardness of the first layer is in a range of from 40 to 70 degrees, the Shore D hardness of the second layer is in a range of from 30 to 60 degrees, and the Shore D hardness of the third layer is in a range of from 40 to 70 degrees.

* * * * *